United States Patent [19]

Martin

[11] Patent Number: 4,680,717

[45] Date of Patent: Jul. 14, 1987

[54] MICROPROCESSOR CONTROLLED LOOP DETECTOR SYSTEM

[75] Inventor: Marshall H. Martin, Northridge, Calif.

[73] Assignee: Indicator Controls Corporation, Gardena, Calif.

[21] Appl. No.: 651,480

[22] Filed: Sep. 17, 1984

[51] Int. Cl.[4] ..... G08G 1/07; G08G 1/01

[52] U.S. Cl. ..... 364/436; 340/917; 340/941

[58] Field of Search ..... 364/436, 438; 331/65; 340/933, 939, 909, 910, 911, 941, 917

[56] References Cited

U.S. PATENT DOCUMENTS

| | | | |
|---|---|---|---|
| 3,863,206 | 1/1975 | Rabie | 340/939 |
| 3,873,964 | 3/1975 | Potter | 340/939 |
| 3,875,555 | 4/1975 | Potter | 340/939 |
| 3,940,678 | 2/1976 | Koyama | 365/149 |
| 3,943,339 | 3/1976 | Koerner et al. | 340/939 |
| 4,358,749 | 11/1982 | Clark | 340/939 |
| 4,430,636 | 2/1984 | Bruce | 340/941 |

*Primary Examiner*—Parshotam S. Lall

*Assistant Examiner*—Thomas G. Black

*Attorney, Agent, or Firm*—Keith D. Beecher

[57] ABSTRACT

A microprocessor controlled loop detection system to be connected to a number of inductive loops which are buried in a road bed and which is used to detect the presence of motor vehicles above the loops to control the operation of traffic lights at an intersection. A common oscillator is connected to each loop on a time-shared basis under the control of a microprocessor, and the frequency of the oscillator in each instance is dependent upon whether or not there is a vehicle above the loop. The microprocessor provides a null time as the system is switched from one loop to another to prevent spurious responses in the system due to transient signals. The microprocessor acts to count the number of cycles of the output signal of the oscillator which occur during a predetermined time interval as each loop is connected to the oscillator by the microprocessor to determine the oscillator frequency for each loop and thereby detect the presence of a vehicle in the particular loop. A synchronizing circuit is provided connecting the oscillator to the microprocessor for controlling the start and finish of each such counting interval by the microprocessor.

3 Claims, 5 Drawing Figures

MICROPROCESSOR CONTROLLED LOOP DETECTOR SYSTEM

BACKGROUND OF THE INVENTION

Many different types of vehicle detection systems are presently in widespread use, either to control traffic signals, or for other purposes. One such prior art detection system uses an electric switch which is mechanically operated by a treadle mounted on the surface of the roadway. However, such mechanical treadle switches are expensive to install. Moreover, they are subject to considerable wear, and they require frequent maintenance.

Sub-surface magnetic inductance vehicle detection systems are also in use which employ inductive wire loops buried beneath the surface of the roadway, and whose inductance changes as a vehicle crosses into the area circumscribed by the loop. Such prior art detection systems usually include an electronic detector circuit which senses the changes in inductance in the loop by measuring a change in frequency of the output of an oscillator, thereby detecting the presence of the vehicle.

Such a magnetic inductance vehicle detection system is described, for example, in U.S. Pat. No. 3,875,555 which is assigned to the present assignee. The system described in the patent is particularly suited for application in operating traffic actuated traffic lights. The system of the patent includes a reference oscillator, and a loop oscillator which exhibits a frequency differential with the reference oscillator in the presence of a vehicle over the loop which forms the resonant circuit for the loop oscillator. This frequency differential is sensed by the system, and if it exceeds a particular threshold, an output call signal is produced. The system described in the patent also incorporates an automatic tracking circuit between the two oscillators so that the loop and circuit changes due to environmental and other conditions are automatically compensated. The frequency differential is detected by counting the successive cycles of the output signals of the oscillators over a predetermined time interval.

The reference oscillator is normally tuned to the same frequency as the loop oscillator, and the two oscillator output signals are formed into square waves which are divided down by means of digital counters. Whenever the frequency of the loop oscillator is increased due to the presence of a vehicle until the frequency differential between it and the reference oscillator exceeds a particular threshold, a square wave appears in the system which is converted into a direct current voltage call signal. The call signal is used in appropriate control circuitry to activate the traffic lights. Different sensitivities may be selected by changing the division factor of the digital counters.

As mentioned above, the system of the patent includes an inductive loop embedded in the roadway and which is used as part of the resonant circuit of the loop oscillator. This means that the frequency of the loop oscillator is a function of loop inductance, and whenever a vehicle enters the area circumscribed by the loop, the inductance of the loop drops; which, in turn, increases the frequency of the loop oscillator. It is clear, therefore, that should the loop oscillator frequency decrease with respect to the reference oscillator frequency, such a decrease is due only to environmental drift conditions, so that the tracking circuit may compensate the frequency differential on a rapid basis.

However, when the frequency of the loop oscillator increases with respect to the reference oscillator, the increase may be due to the presence of a vehicle, or to environmental drift conditions. Therefore, the compensation by the tracking circuit for the later instance must proceed in a slower basis than in the former instance, so that compensation is provided only in the presence of slow environmental drifts, rather than in response to a sharp increase in frequency due to the presence of a vehicle. To achieve stability, the loop and reference oscillators must track in terms of frequency. The frequency difference between the two oscillators is monitored in the system described in the patent, so that whenever the loop oscillator frequency becomes lower than the reference oscillator frequency, indicating an environmental frequency drift condition, an error signal is produced. This error signal is in the form of a pulsating signal, and it is fed to the input of a digital integrator. The resulting output of the integrator is used to increase the loop oscillator frequency at a relatively high correction rate, and this continues until the error signal disappears.

On the other hand, whenever the frequency of the loop oscillator becomes higher than the frequency of the reference oscillator in the system described in the patent, a condition which may be caused either by variations in the loop inductance due to environmental changes, or to the presence of a vehicle over the loop, the tracking circuit develops a low rate error signal which is introduced to the input of the digital integrator so that correction to reduce the frequency of the loop oscillator proceeds at a relatively low rate for long term automatic tracking to compensate for slow environmental drift conditions, but which does not respond to rapid frequency changes due to the presence of a vehicle.

The microprocessor system of the present invention provides the same functional operations as the system described in the patent. However, in the system of the invention a single loop oscillator is used in conjunction with a number of separate loops, which are located, for example, at each corner of an intersection, and the microprocessor serves sequentially to connect each loop to the common oscillator on a multiplexed time-shared basis. All of the detector functions performed by the circuitry described in the patent, as discussed above, are performed by the microprocessor.

DETAILED DESCRIPTION OF THE ILLUSTRATED EMBODIMENT

Like the system of the patent, the present system may be set to a "pulse" mode in which it generates a call signal of predetermined duration for each vehicle moving into the area circumscribed by a loop; or it may be set to a "presence" mode in which it produces a call signal in response to the presence of a vehicle within the loop and which continues so long as the vehicle remains over the loop. The system, in its "pulse" mode is well adapted for measuring or counting rapidly moving traffic. In the "presence mode", the signal starts when the inductance of a loop is first decreased due to the close proximity of a vehicle, and it terminates when the inductance of the loop regains its previous value as the vehicles leaves the loop.

As mentioned above, the detector function of the system of the invention is similar to that described in the patent, but this function is performed by a microprocessor and is based on an algorithm. This algorithm causes detection to occur when a conductive metallic mass enters any one of the four loops to produce an inductance change in the particular loop of, for example, from 0.01% to 0.343% over the environmental drift, depending upon settings of appropriate command switches. The algorithm provides automatic tracking of loop inductance changes due to environmental drifts, but inhibits tracking during the first three minutes when the system is in the presence mode.

The system is set to its "pulse" mode or "presence" mode by input command switches. Further command switches are provided for setting the sensitivity of the system. All four channels in the embodiment to be described respond to vehicle detection within 2 milliseconds for the least sensitive switch setting to 50 milliseconds for the most sensitive switch setting.

Selected channels of the four channels of the system to be described when in their "presence" mode provide "extend" or "delay" detection of any vehicle entering the corresponding loops which may be timed from 0–31½ seconds, and which are operationally enabled by an electronic command. The "extend" detection produces a call signal immediately upon the entry of a vehicle over a loop, and the call signal continues for a pre-set time after the vehicle has left the loop, for example, for controlling left turn signals; and the "delay" detection causes the call signal to occur a predetermined time after the vehicle has entered the loop, and to terminate immediately after the vehicle has left the loop.

Figure 1A:
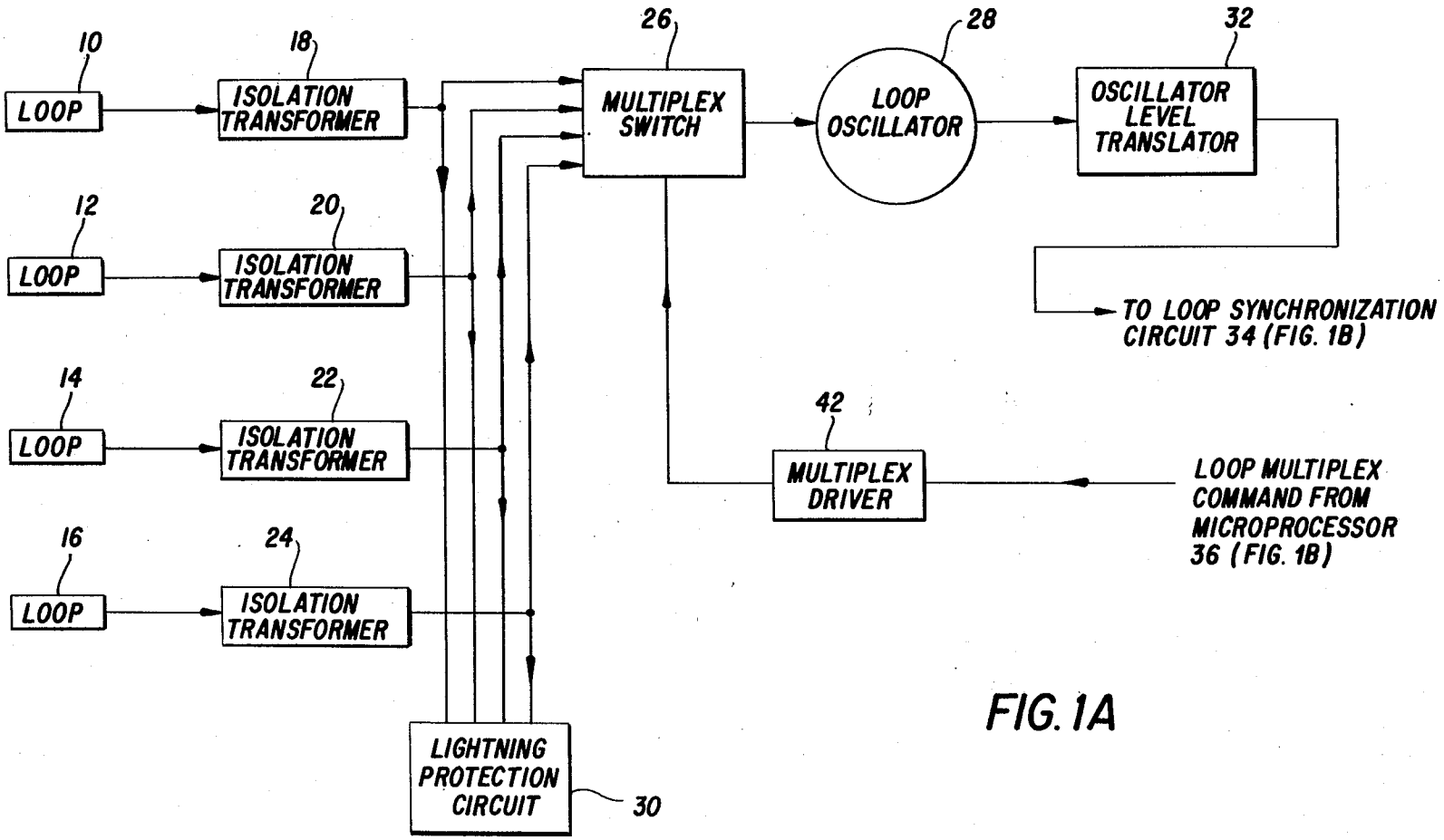
FIGS. 1A and 1B together represent a block diagram of the system of the invention in its presently preferred embodiment.
Figure 1B:
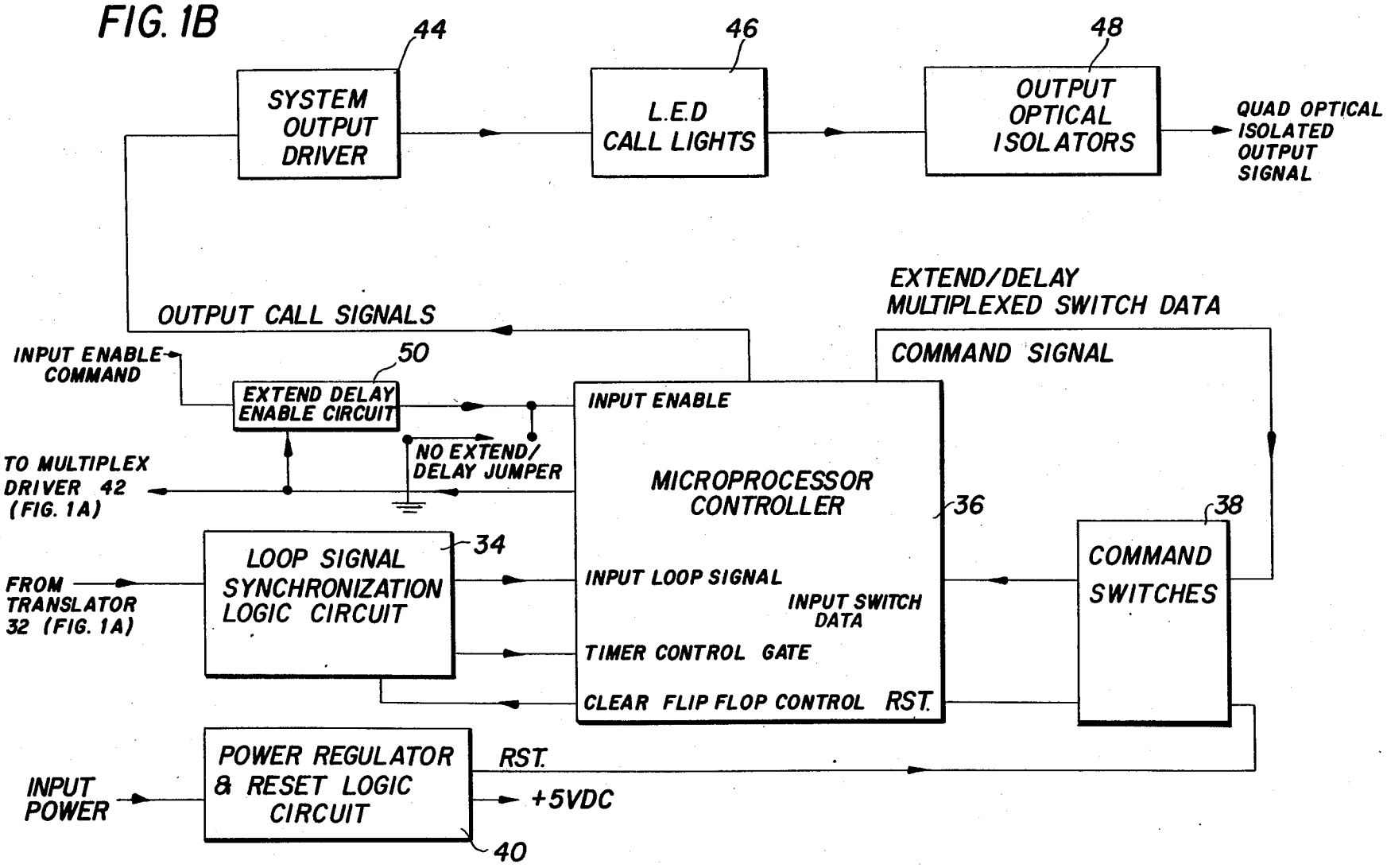

The system shown in the block diagram of FIGS. 1A and 1B includes four inductive loops 10, 12, 14 and 16 which, for example, are buried in a roadway at the four corners of an intersection. The loops are coupled to respective isolation transformers 18, 20, 22 and 24 and the transformers, in turn, are connected through a multiplex switch 26 to a common loop oscillator 28.

A lightning protection circuit 30 is provided for protecting the system from current surges due to lightning strikes.

The oscillator 28 is connected through an oscillator level translator circuit 32 to a loop synchronization logic circuit 34 in FIG. 1B. Circuit 34 provides an input loop signal and a timer control gate signal to a central processing unit 36. Unit 36 may take the form of a microprocessor controller of the type designated 8051. A plurality of command switches 38 are provided (FIG. 1B) which are connected to controller 36. A power regulator and reset logic circuit 40 is provided which serves to regulate the input power, and which also provides a reset signal to controller 36 through one of the command switches 38.

The controller 36 provides a loop multiplex command signal for a multiplex driver 42 (FIG. 1A) which controls the multiplex switch 26 so that the loops 10, 12, 14 and 16 are sequentially and cyclically connected to the common oscillator 28. The controller 36 also produces an output call signal which is introduced to an optical isolator driver 44 (FIG. 1B). Driver 44 may be an optical buffer of the type designated 74LS468. It drives a number of L.E.D. call lights represented by block 46 and to an optical isolator output stage represented by block 48. Stage 48 produces output call signals for the traffic lights controlled by the system. An input enable command is applied to an extend/delay enable circuit 50 which is connected to the controller. A jumper is provided to connect the output of circuit 50 to ground in the event that no extend/delay feature is to be used in the system.

Loop synchronization logic circuit 34 serves to inform the controller 36 when to start counting the cycles of the output signal from oscillator 28 after each one of the loops 10, 12, 14 and 16 has been connected to the oscillator. The controller indicates when such a count should begin, but it is out of synchronization with the loop oscillator. The synchronization circuit assures that the controller will start its count upon the first positive transition of the output signal following the indication by the controller that a count should begin so as to minimize counting errors.

The loop isolation transformers 18, 20, 22 and 24 provide high impedance isolation between each of the loops 10, 12, 14 and 16 and the system. These transformers also form part of the lightning protection circuit 30. The loop level translator 32 squares the loop oscillator output signals and translates the loop oscillator output signal levels (which are not TTL compatible) to the proper signal level for proper operation of the loop signal synchronization circuit 34. The system channels associated with loops 10 and 12 of FIG. 1A, are capable of operation in the extend and delay modes in response to an external input enable command applied to the extend/delay enable circuit 50. The command switches 38 are multiplexed so that the number of switches may be matched with the available number of pins of controller 36.

Figure 2A:
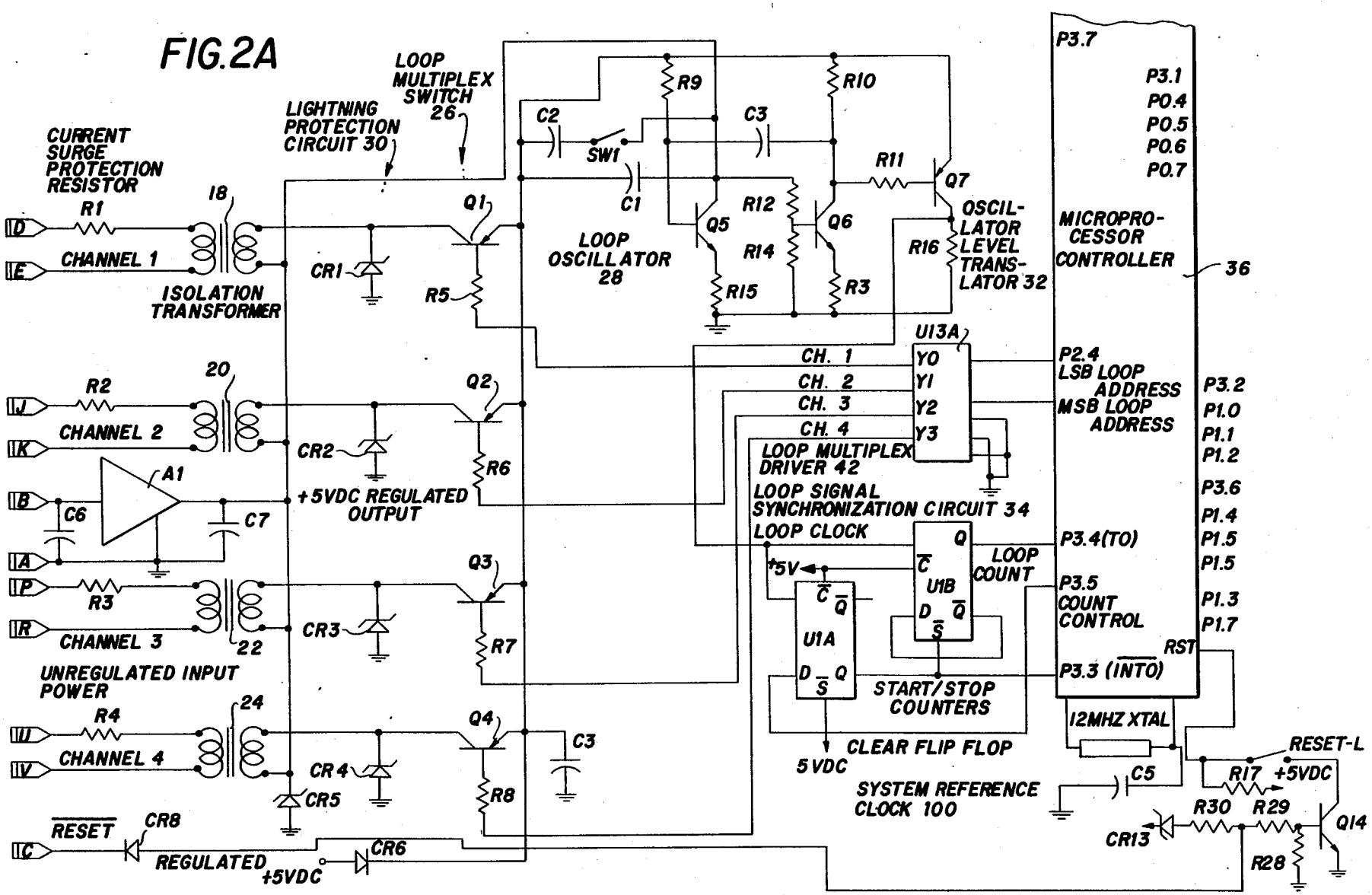
FIGS. 2A, 2B, and 2C jointly represent a schematic circuit diagram of the system.
Figure 2B:
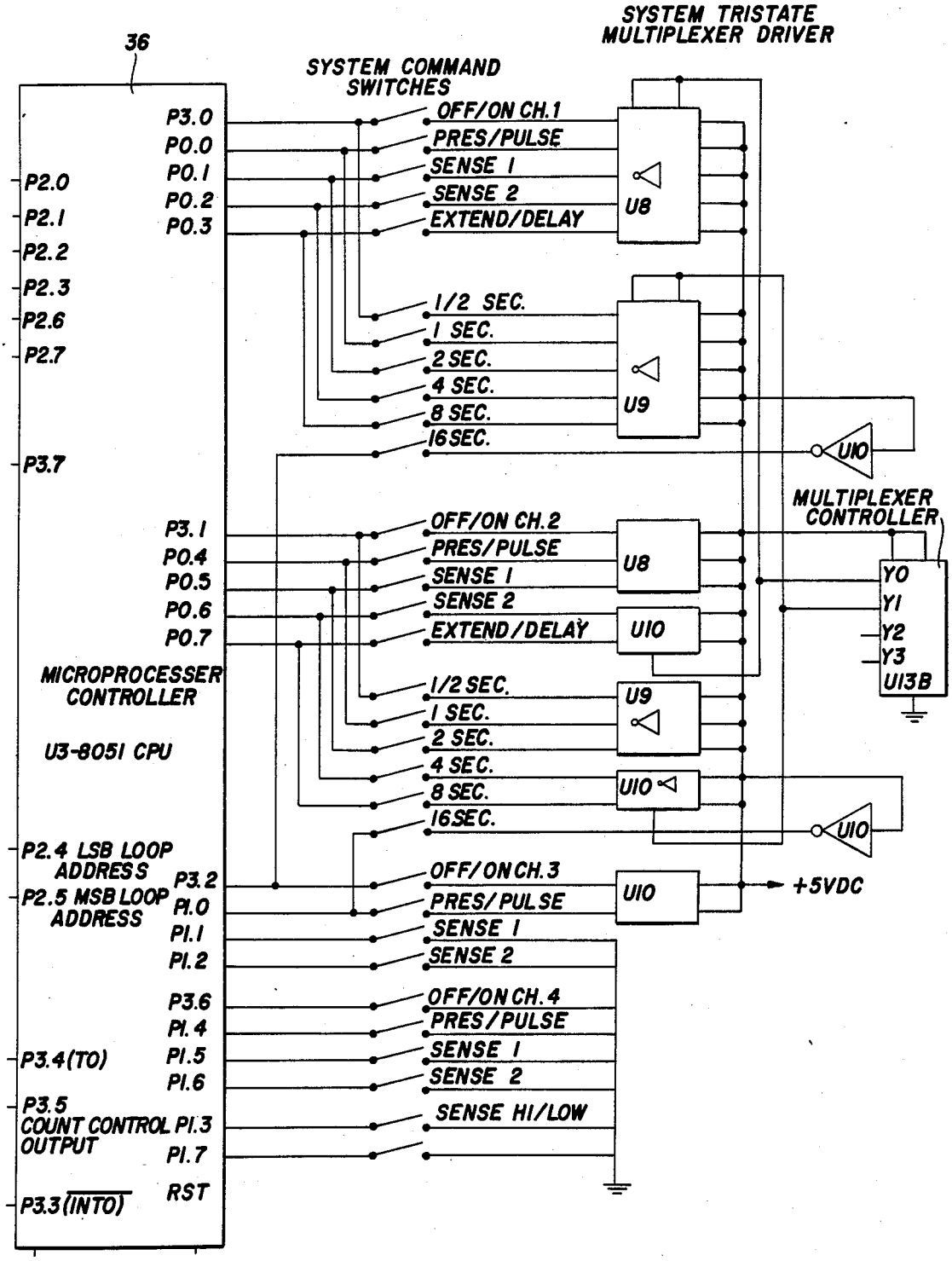
Figure 2C:
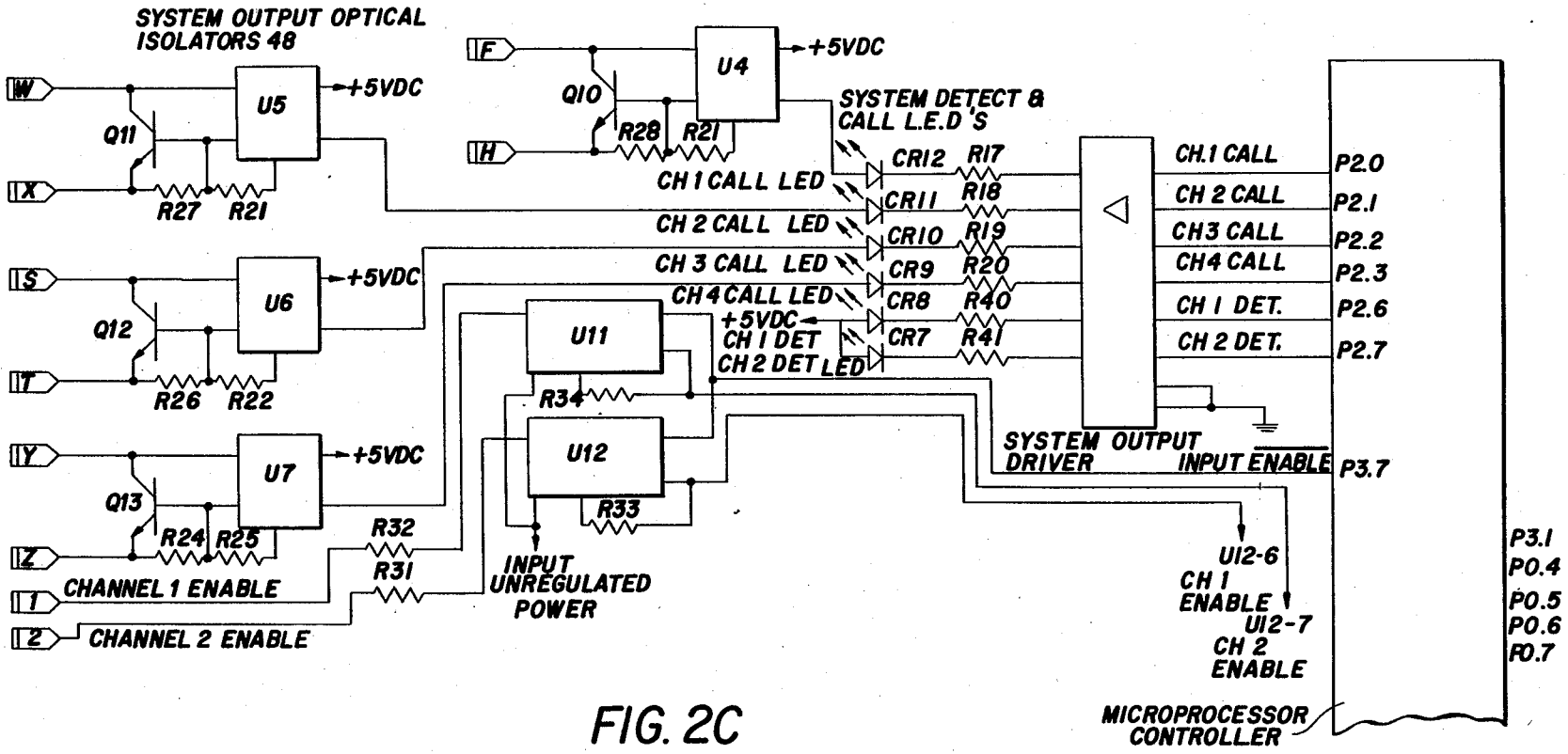

In the circuit of FIGS. 2A, 2B and 2C, the various circuit components are mounted on a usual circuit card having contacts mounted on one edge of the card. Contacts D and E, J and K, P and R, and U and V are respectively connected to the loops 10, 12, 14 and 16 (FIG. 1A), and contacts D, J, P and U are connected through respective current surge protection resistors R1, R2, R3 and R4 to the primary windings of isolation transformers 18, 20, 22 and 24. Each of the resistors may have a resistance of 5 ohms.

Zener diodes CR1, CR2, CR3 and CR4 connect one side of the secondaries of the respective transformers 18, 20, 22 and 24 to ground, and serve to limit the amplitude of any lightning voltage surge. The Zener diodes also operate in conjunction with resistors R1, R2, R3 and R4, and transformers 18, 20, 22 and 24 to provide a current limiting and high impedance effect in response to such lightning voltage surges thereby to protect the system. The other side of each of the secondary windings is connected to ground through a Zener diode CR5.

The loop multiplex switch 26 is formed by a series of PNP transistors Q1, Q2, Q3 and Q4, each of which may be of the type designated 2N5227. The transistors Q1, Q2, Q3 and Q4 are controlled by loop multiplex driver 42 which comprises a decoder U13A which decodes the address lines P2.4 and P2.5 of controller 36. Decoder U13A serves to convert the binary signals appearing at the pins P2.4 and P2.5 into corresponding decimal signals identifying channels 1–4 which correspond respectively to loops 10, 12, 14 and 16 of FIG. 1A. Decoder U13A may be of the type designated LS155. The decoder output terminals are connected respectively to the base electrodes of the corresponding transistors Q1–Q4 through respective 1.5 kilo-ohm resistors R5, R6, R7 and R8. The transistors Q1–Q4 are turned on sequentially and cyclically by decoder U13A.

The controller inserts a null time between the selection of each multiplexed channel in its control of decoder U13A, so that the system is not switched from one channel to the next until the oscillator output is reduced to zero, so that inter-channel interaction is eliminated. The null time may be determined by a timer in the controller. The null time is made as short as possible, and it may be different for different channels, as determined for example, by the quality factor (Q) of each channel. The controller 36 reads the command switches 38 (FIG. 1B), and if any of the channel switches included therein are in the "off" position, the corresponding transistors are not activated. In this way the same system may be used to control a single traffic light, or any number of traffic lights. It should be noted that when any of the channels are de-activated, there is no dead time as the controller sequentially activates the remaining channels.

The emitters of the multiplexing transistors Q1, Q2, Q3 and Q4 are coupled to the loop oscillator 28 through a 5600 picofarad capacitor C1. The loop oscillator is formed of a paCir of NPN transistors Q5 and Q6 which may be of the type designated 2N3904. The oscillator also includes a 100 ohm resistor R3, a 150 ohm resistor R15, a 22 kilo-ohm resistor R12, a 4.71 ohm resistor R14, an 820 ohm resistor R10 and a 27 kilo-ohm resistor R9, and a 0.05 microfarad capacitor C3. The multiplexer transistors Q1, Q2, Q3 and Q4 are also coupled to the loop oscillator through a 5600 picofarad capacitor C2 and a high/low frequency switch SW1.

The oscillator level translator circuit 32 is formed of a PNP transistor Q7 which may be of the type designated 2N5227. Collector of transistor Q6 is connected to the base of transistor Q7 through a 10 kilo-ohm resistor R11. The collector of transistor Q7 is connected to ground through a 5.1 kilo-ohm resistor R16 and to the loop synchronization circuit 34. As mentioned above, this circuit serves to square the output of the loop oscillator 18 and to set it to a level compatible with the loop signal synchronization circuit 34.

The loop signal synchronization circuit 34 is made up of a pair of "D" flip-flops U1A and U1B (FIG. 2A) which may be included in a single integrated circuit chip of the type designated C74. The Q output of flip-flop U1B provides the loop count signal to pin P3.4 of controller 36, in response to the loop oscillator output derived from translator 32, designated "loop clock" is introduced to pin 3 of flip-flop U1A and to pin 11 of flip-flop U1B. The synchronization circuit 34 informs the controller when to start counting the loop clock pulses.

When a particular channel has been selected by the controller 36 through a multiplexer decoder U13A, the beginning of the time interval during which the controller counts the loop oscillator cycles is indicated by the pin P3.5 going from logic 0 to logic 1. This causes the D input of flip-flop U1A to go high and its Q output likewise to go high. This causes controller pin P3.3 to go high indicating the start of the counting interval and enabling the interval counter of the controller. The clear signal $\overline{S}$ is also removed from flip-flop U1B.

The incoming clocks from translator circuit 32 now toggle flip-flop U1B, and each positive transition of the Q output of that flip-flop actuates the interval counter of controller 36.

At the end of a predetermined time interval, pin P3.5 goes low. This causes the D input and Q output of flip-flop U1A to go low, stopping the operation of flip-flop U1B and stopping the interval counter in the controller by setting controller pin P3.3 low. The controller now computes the number of cycles of the loop oscillator counted in the predetermined interval to decide whether or not to generate a call signal for the particular channel selected by the controller.

Unregulated input power is introduced to the system through contacts A and B of FIG. 2A, and the input power is regulated in integrated circuit A1 which may be of the type designated LM340-5 to produce a +5 volts DC regulated output. A grounded 0.1 microfarad capacitor C6 is connected to the input of A1, and a grounded 33 microfarad capacitor C7 is connected to the output.

The controller 36 is reset whenever the input power voltage level is low, or a logic "0" reset signal level is input at contact C (FIG. 2A) through diode CR8. The controller 36 is programmed to switch to an auto retune program whenever it is reset. A reset condition exists in the controller whenever the reset logic or reset-L switch places a logic "1" at pin RST of the controller.

Diode CR8 is connected to the junction of a pair of 2.2 kilo-ohm resistors R29 and R30 which connect the base of an NPN transistor 014 through a Zener diode CR13 to the unregulated input DC power contact B. Transistor Q14 is of the type designated 2N3904. Its emitter is grounded, and its collector is connected to the reset-L switch. The RST pin of processor 36 is connected to the positive terminal of the 5 volt regulated direct current source through a 10 kilo-ohm resistor R17.

The system also includes a reference clock oscillator 100 connected to the controller 36 and which includes a grounded 20 picofarad capacitor C5 and which is stabilized at 12 megahertz by an appropriate crystal. The controller generates the output call signals when the frequency differential between the loop oscillator and the reference clock oscillator exceeds a predetermined threshold.

The various command switches for the system are shown in FIG. 2B. The command switches are multiplexed, so that a larger number of switches than available controller pins may be used. The multiplex is carried out by tri-state multiplexers designated U8, U9 and U10, which may be of the type designated LS468. The multiplexers are controlled by a multiplexing switch U13B which may be of the type designated LS155.

The multiplexers U8, U9 and U10 are tri-state octal inverting buffer integrated circuit chips. The program within microprocessor controller 36 causes the controller to command the integrated circuit chips U8, U9 and U10 to be multiplexed circuit logic by placing the desired chip to be multiplexed into and out of its tri-state. This is achieved under the control of the controller U13B which may be of the type designated LS155.

As shown, each channel includes an off/on switch, so that any of the channels may be de-activated. When any channel is de-activated, the controller 36 polls the remaining actuated channels without any dead time for the de-activated channels. Each channel also includes a presence/pulse switch which places the individual channel either in the presence mode or pulse mode described above. Each channel further includes sensitivity switches which control the sensitivity of the detector for the corresponding channels in a plurality of different levels depending upon various combinations of switch closures in conjunction with the open or closed condition of a sense hi/low switch.

Channels 1 and 2 also include extend/delay switches, and a further group of switches, in each instance, controls the time of extension or delay in increments of 0-31½ seconds depending upon the combination of open and closed switches.

As shown in FIG. 2C, the output pins P2.0 P2.1, P2.2, P2.3, P2.6 and P2.7 of the microprocessor controller are connected to an output driver 44, which may be an octal buffer of the type designated 74LS468 which is used to drive the L.E.D. call lights CR7, CR8, CR9, CR10, CR11 and CR12 of FIG. 2C, represented by block 46 of FIG. 1B. Output driver 44 drives the L.E.D.'s through respective 510 ohm resistors R17, R18, R19, R20, R40 and R41. The L.E.D.'s CR12, CR11, CR10, CR9 and CR8 respectively indicate the presence of a call signal on a corresponding channel 1, 2, 3 or 4. L.E.D.'s CR8 and CR7 immediately indicate the detection of a vehicle in channels 1 or 2 when the channels are in the delay mode.

The output optical isolators represented by block 48 in FIG. 1B are shown in FIG. 2C to be optical isolator circuits U4, U5, U6, U7, U11, and U12, of the type designated OP12252. The optical output isolators U4–U7 are connected to output contacts F and H, W and X, S and T, and Y and Z. NPN transistors Q10–Q13 are connected across the outputs of the respective optical isolators U4–U7, and these may be of the type designated 2N3904.

The base of transistor Q10 is connected to the junction of a 10 kilo-ohm resistor R28 and a 2.2 megohm resistor R20. The base of transistor Q11 is connected to the junction of a 10 kilo-ohm resistor R27 and a 2.2 megohm resistor R21. The base of transistor Q12 is connected to the junction of a 10 kilo-ohm resistor R26 and a 2.2 megohm resistor R22. The base of transistor Q13 is connected to the junction of a 10 kilo-ohm resistor R24 and a 2.2 megohm resistor R25.

The output optical isolators each provide a logic "0" to the peripheral electronic system upon the occurrence of a corresponding output call signal.

Input enable commands for channels 1 and 2 extend and delay times are applied to contacts 1 and 2 of FIG. 2C, which are connected to optical isolators U11 and U12 through respective 3.3 kilo-ohm resistors R32 and R31. Circuits U11 and U12 may be of the type designated OP12252. These circuits are connected to the input enable pin P3.7 of the microprocessor controller, and provide "extend" and "delay" enable signals to channel 1 and channel 2.

While a particular embodiment of the invention has been shown and described, modifications may be made. It is intended in the claims to cover all modifications which come within the true spirit and scope of the invention.

I claim:

1. A microprocessor controlled detection system connected to a plurality of inductive loops buried in a road bed and used to detect the presence of motor vehicles over the respective loops, said system comprising: a common oscillator circuit for generating an output signal of a particular frequency which is subject to change when a motor vehicle passes over any one of the loops; a switching circuit for connecting respective ones of the loops on a sequential and cyclic basis to the oscillator circuit; a microprocessor controller connected to said switching circuit for supplying switching signals to said switching circuit to enable said switching circuit sequentially and cyclically to connect the loops to said oscillator circuit; an input circuit connecting said microprocessor controller to enable said microprocessor controller to count the cycles of the output signal from said oscillator as said loops are sequentially and cyclically connected to said oscillator; an output circuit connected to said microprocessor controller for providing a plurality of separate output call signals in response to cycles of said output signal counted by said controller to indicate when a change has occurred in the frequency of the output signal from said oscillator beyond a pre-selected threshold when corresponding ones of said loops are connected to said oscillator circuit; means in said microprocessor controller for providing a null time between each connection of said loops to said oscillator circuit by said switching circuit; circuit means included in said input circuit for synchronizing the oscillator with the microprocessor controller so that the count by the microprocessor controller will commence upon the occurrence of a particular transition of the oscillator output signal after the controller has been conditioned to make a count after a particular loop has been connected to the oscillator by said switching circuit; and a plurality of manually-operated command switches connected to said microprocessor controller, in which the manually-operated command switches include a plurality of on-off switches for deactivating different channels of said system, and means in said microprocessor controller responsive to the settings of the on-off switches for causing said microprocessor controller to supply switching signals to said switching circuit corresponding to less than all of the channels and without any dead time for the de-activated channels.

2. The microprocessor controlled detection system defined in claim 1, in which the command switches also include pulse/presence switches for each of the loops, and means in said microprocessor controller responsive to the settings of said pulse/presence switches for establishing each of said loops in either a pulse or a presence mode.

3. A microprocessor controlled detection system connected to a plurality of inductive loops buried in a road bed and used to detect the presence of motor vehicles over the respective loops, said system comprising: a common oscillator circuit for generating an output signal of a particular frequency which is subject to change when a motor vehicle passes over any one of the loops; a switching circuit for connecting respective ones of the loops on a sequential and cyclic basis to the oscillator circuit; a microprocessor controller connected to said switching circuit for supplying switching signals to said switching circuit to enable said switching circuit sequentially and cyclically to connect the loops to said oscillator circuit; an input circuit connecting said microprocessor controller to enable said microprocessor controller to count the cycles of the output signal from said oscillator as said loops are sequentially and cyclically connected to said oscillator; an output circuit connected to said microprocessor controller for providing a plurality of separate output call signals in response to cycles of said output signal counted by said controller to indicate when a change has occurred in the frequency of the output signal from said oscillator beyond a pre-selected threshold when corresponding ones of said loops are connected to said oscillator circuit; means in said microprocessor controller for providing a null time between each connection of said loops to said oscillator circuit by said switching circuit; circuit means included in said input circuit for synchronizing the oscillator with the microprocessor controller so that the count by the microprocessor controller will commence upon the occurrence of a particular transition of the oscillator output signal after the controller has been conditioned to make a count after a particular loop has been connected to the oscillator by said switching circuit; and a plurality of manually-operated command switches connected to said microprocessor controller, in which the command switches include an extend-/delay switch, and means in said microprocessor controller responsive to the setting of said extend/delay switch for establishing a corresponding one of the loops in either an extend or delay mode.

* * * * *